US006380831B1

(12) United States Patent
Kajino

(10) Patent No.: US 6,380,831 B1
(45) Date of Patent: Apr. 30, 2002

(54) STARTER MOTOR MAGNETIC SWITCH HAVING AUXILIARY RELAY

(75) Inventor: Sadayoshi Kajino, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/953,879

(22) Filed: Sep. 18, 2001

(30) Foreign Application Priority Data

Nov. 6, 2000 (JP) ..... 2000-337930

(51) Int. Cl.[7] ..... H01H 67/02
(52) U.S. Cl. ..... 335/127; 335/126; 335/131
(58) Field of Search ..... 335/106, 126, 335/127, 129, 131, 159–163

(56) References Cited

U.S. PATENT DOCUMENTS 5,677,656 A 10/1997 Mauch et al. ..... 335/126
5,892,422 A * 4/1999 Montaigu et al. ..... 335/126

* cited by examiner

*Primary Examiner*—Ramon M. Barrera
(74) *Attorney, Agent, or Firm*—Law Offices of David G. Posz

(57) ABSTRACT

A magnetic switch having a main motor switch for supplying power from a battery to a starter motor and an auxiliary relay for operating the motor switch is mounted on the starter motor. The main motor switch includes copper contacts switching a large amount of starter current, and the auxiliary relay includes contacts switching only a small amount of current sufficient to operate the main motor switch. The auxiliary relay is separated from the main motor switch by a wall to protect the auxiliary relay, especially its contacts from copper dusts generated in switching operation of main motor switch. Since the auxiliary relay is kept free from the copper dusts, the magnetic switch properly functions for a long time.

5 Claims, 5 Drawing Sheets

1
22
270b
26c
11b
26
12a
26d
IV
IIIB
11c
26a
26b
28
29
24
200b
200a
11a
12b
200c
210b
210

STARTER MOTOR MAGNETIC SWITCH HAVING AUXILIARY RELAY

CROSS-REFERENCE TO RELATED APPLICATION

This application is based upon and claims benefit of priority of Japanese Patent Application No. 2000-337930 filed on Nov. 6, 2000, the content of which is incorporated herein by reference.

BACKGROUND OF THE INVENTION

1. Field of the Invention

The present invention relates to a magnetic switch of a starter motor for cranking an internal combustion engine, the magnetic switch including an auxiliary relay, upon energization of which a main starter switch is closed to supply power from a battery to the starter motor.

2. Description of Related Art

An example of a magnetic switch of this kind is disclosed in JP-A-8-504913. A main starter switch for supplying battery power to a starter motor and an auxiliary relay that closes the main starter switch upon its energization are disposed in a common contact chamber. The main starter switch is composed of fixed contacts and a movable contact, both made of copper, through which a large amount of starter current is supplied. The movable contact hits the fixed contacts at a considerable speed when closing the starter switch. Therefore, copper dusts are generated by abrasion in operating the switch many times and are scattered in the contact chamber.

The auxiliary relay composed of fixed contacts, a movable contact and a relay coil is disposed in the common contact chamber together with the main starter switch, and moreover, the auxiliary relay is exposed to the main starter switch at the bottom side thereof. The contacts of the auxiliary relay are relatively small because they handle a small amount of current that operates the relay. The copper dusts generated by abrasion of the large contacts of the main starter switch adhere to the auxiliary relay, especially to its contacts. The copper dusts are harmful to insulation in the auxiliary relay and switching operation of the contacts. The copper dusts cause malfunctions of the magnetic switch.

SUMMARY OF THE INVENTION

The present invention has been made in view of the above-mentioned problem, and an object of the present invention is to provide an improved magnetic switch in which abrasion dusts are prevented from entering into a space where the auxiliary relay is installed.

The magnetic switch of the starter motor is mounted on a starter motor. To start an internal combustion engine, the magnetic switch drives its plunger to establish an mechanical engagement between the starter motor and a ring gear of the engine and to supply power from a battery to the starter motor. The magnet switch includes a main motor switch that supplies the battery power to the starter motor upon closing thereof and an auxiliary relay that brings the motor switch to its open or closed position. The motor switch is closed by a plunger driven by a pull-in coil, and its closed position is maintained by a holding coil.

The motor switch includes a movable contact and fixed contacts that handle a large amount of current to be supplied to the starter motor. The auxiliary relay includes a movable contact, stationary contacts and an auxiliary coil for driving the movable contact. The auxiliary relay only handles a relatively small amount of current. The pull-in coil and the holding coil are coaxially wound on a common bobbin, and the auxiliary coil is placed coaxially with the other two coils. A magnetic core which serves as a common magnetic path is positioned between the auxiliary coil and the other two coils wound on the common bobbin.

To start up the engine, a starter switch is closed. Upon closing the starter switch, the auxiliary relay coil is energized to close the auxiliary relay contacts. Upon closing the auxiliary relay contacts, the pull-in coil is energized and the main motor switch is closed to supply the battery power to the starter motor. At the same time, the starter motor is mechanically engaged with the engine, and thereby the rotational torque of the starter motor is transferred to the engine.

The contacts of the main motor switch that are made of copper and handle a large amount of current generate copper dusts in the course of repeated on-and-off operations. If the main switch and the auxiliary relay are placed in a same space, the auxiliary relay, especially its contacts, are exposed to the copper dusts. The copper dusts cause malfunctions of the magnetic switch during the course of long term use. To prevent the auxiliary relay from being exposed to the copper dusts of the main motor switch, a wall separating the auxiliary relay from the main motor switch is provided. The separating wall can be easily provided at a low cost because it has no complex structure.

The auxiliary relay and especially the contacts thereof are kept free from the copper dusts of the main motor switch. Therefore, the starter motor magnetic switch according to the present invention is able to operate for a long time without malfunctions.

Other objects and features of the present invention will become more readily apparent from a better understanding of the preferred embodiment described below with reference to the following drawings.

DETAILED DESCRIPTION OF THE PREFERRED EMBODIMENT

Figure 1:
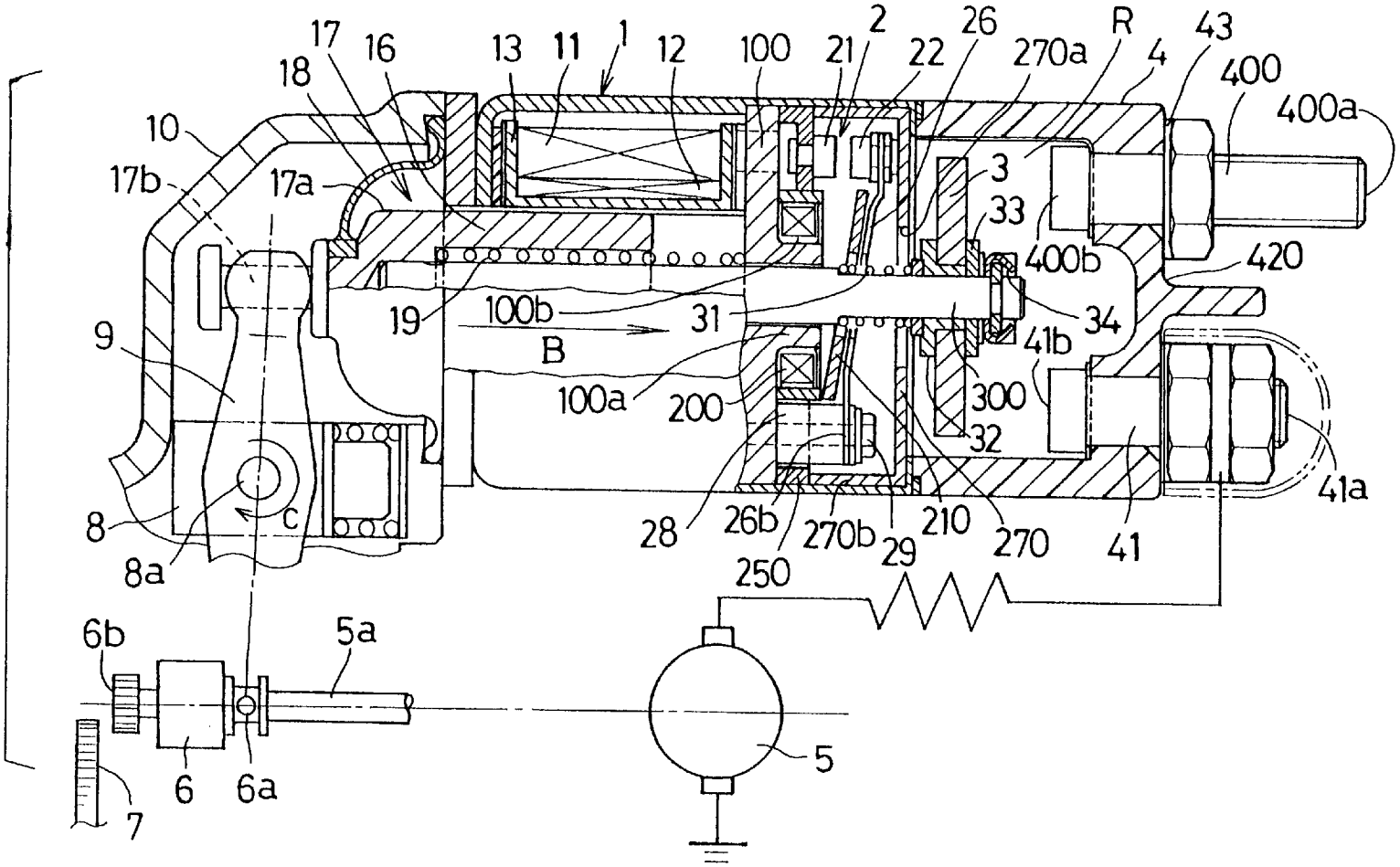
FIG. 1 is a cross-sectional view showing a starter motor magnetic switch according to the present invention.

A preferred embodiment according to the present invention will be described with reference to accompanying drawings. FIG. 1 shows a structure of the magnetic switch to be connected to and mounted on a starter motor 5 for cranking an internal combustion engine. The magnetic switch is composed of a main motor switch, an auxiliary relay 2, a pull-in coil 11, a holding coil 12, a plunger 17 and other components. All of those components are housed in a unitary housing constituted by a center housing 1, a front housing 10. and a rear housing 4.

The holding coil 12 and the pull-in coil 11 are coaxially wound around a bobbin 13 made of resin, and the bobbin 13 is mounted in the center housing 1, as shown in FIG. 1. The plunger 17 and a plunger rod 300 are disposed in a center hole of the bobbin 13 so that they slidably and reciprocally move in the axial direction. The plunger rod 300 is disposed in a sleeve 16 of the plunger 17. The plunger 17 and the plunger rod 300 are biased in the leftward direction in FIG. 1 by a coil spring 19 disposed between a left side shoulder of the plunger 17 and a magnetic core 100.

Figure 2:
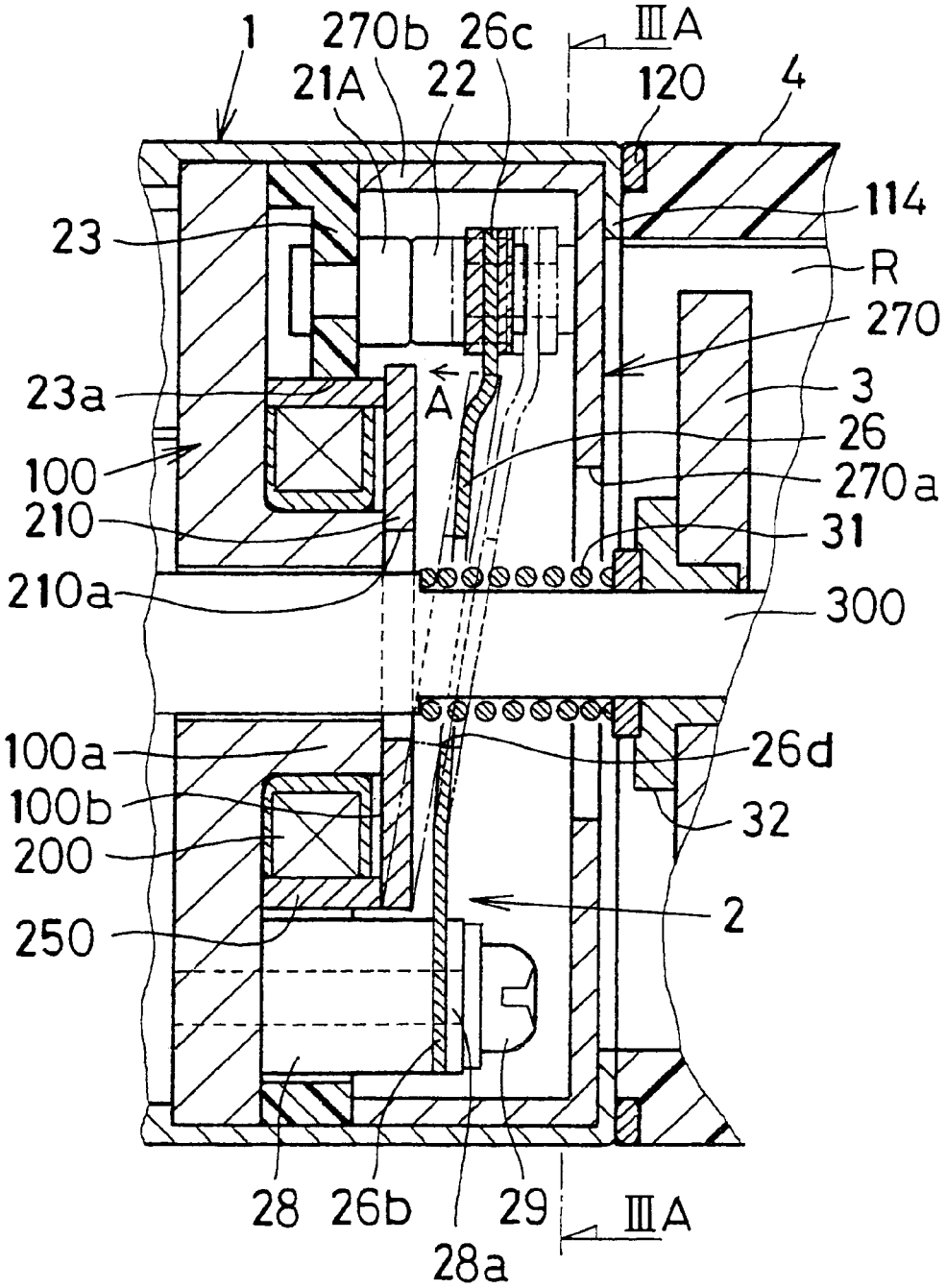
FIG. 2 is an enlarged cross-sectional view showing an auxiliary relay included in the magnetic switch shown in FIG. 1.

The magnetic core 100, as shown in FIG. 2 in detail, is disc-shaped and includes a boss 100*a* formed at its center and an outer periphery 100*b* formed outside the boss 100*a*. The magnetic core 100 is positioned at the right side of the bobbin 13 as shown in FIG. 1. The center hole of the magnetic core 100 slidably supports the plunger rod 300. An auxiliary coil 200 constituting the auxiliary relay 2 is disposed in the outer periphery 100*b* around the boss 100*a*, and a magnetic ring 250 is disposed outside of the auxiliary coil 200. The auxiliary coil 200 is held between the boss 100*a* and the magnet ring 250 by filling resin. Then magnetic core 100 serves as a magnetic flux path common to all the coils, the pull-in coil 11, the holding coil 12 and the auxiliary coil 200. The auxiliary coil 200 and the holding coil 12 are connected in series to generate a magnetic flux in the same direction.

Figure 4:
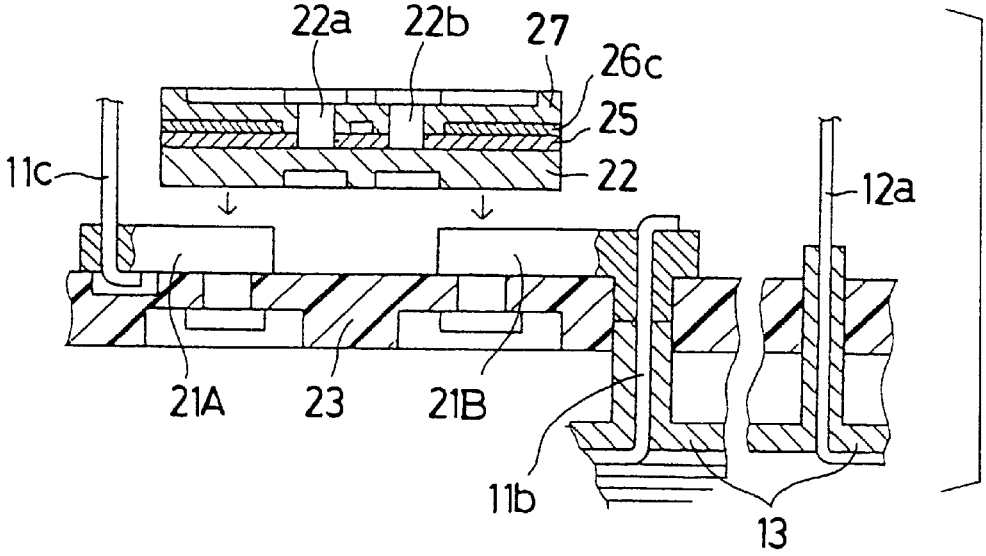
FIG. 4 is a cross-sectional view showing a movable contact and fixed contacts in the auxiliary relay, taken along line IV—IV in FIG. 3A.

A supporting disc 23 having a center hole 23*a* is made by resin-molding. The center hole 23*a* of the supporting disc 23 is fixed to the outer periphery of the magnetic ring 250, and the outer periphery of supporting disc 23 is held inside the center housing 1, as shown in FIG. 2. A fixed contact 21 of the auxiliary relay 2 includes a pair of contacts 21A and 21B as shown in FIG. 4. The pair of fixed contacts 21A and 21B (only 21A is shown in FIG. 2) are fixed to the supporting disc 23 by caulking, screw-fastening or the like method, or they may be insert-molded together with the supporting disc 23. An anchor portion 26*b* of a leaf spring 26 is fixed to the supporting disc 23 by a screw 29, with a pipe-shaped spacer 28 and a washer 28*a* interposed therebetween.

Figures 3A, 3B, 3C:
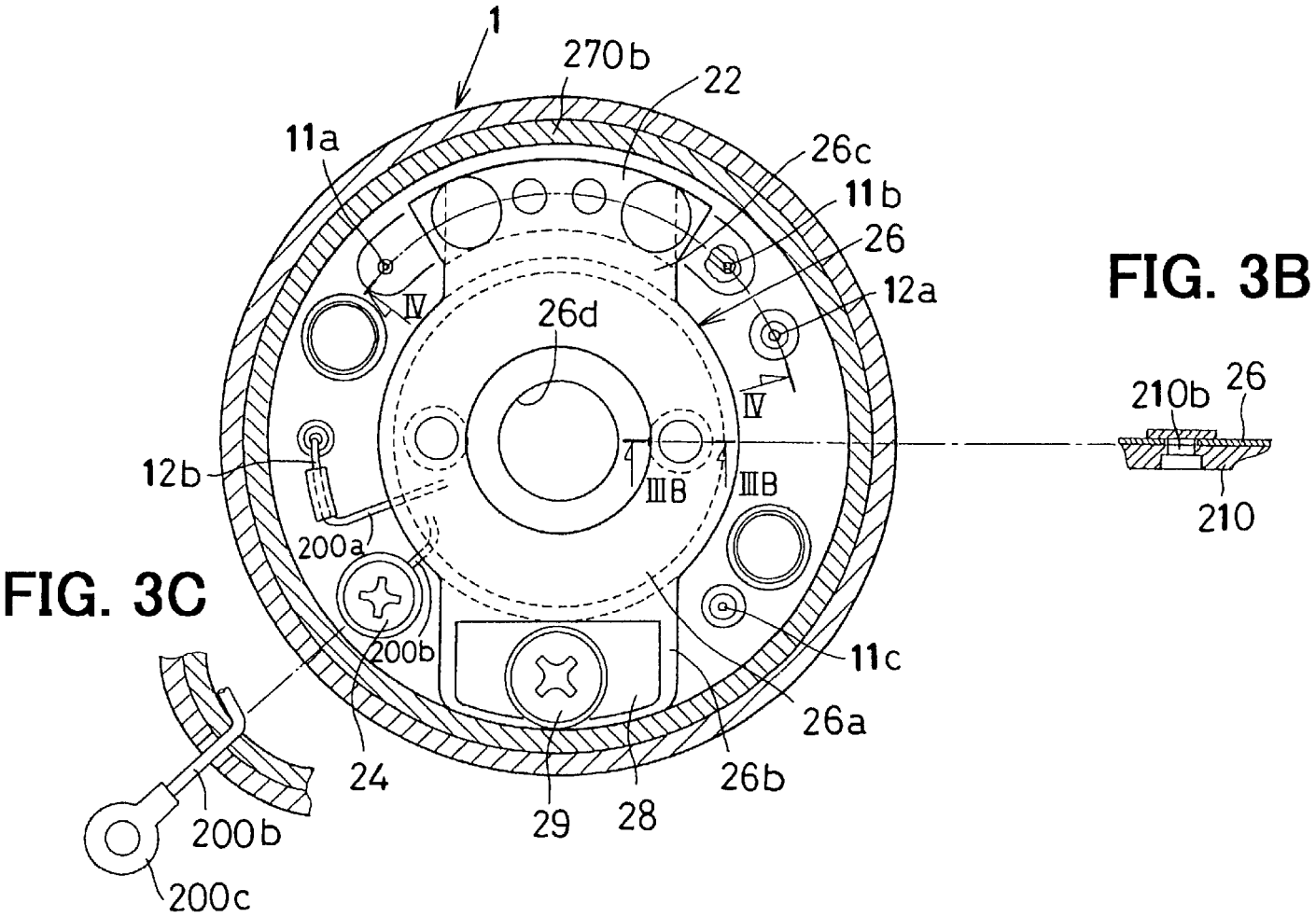
FIG. 3A is a cross-sectional view showing a leaf spring and associated parts thereto, taken along line IIIA—IIIA in FIG. 2.
FIG. 3B is a partial cross-sectional view showing the leaf spring and a magnetic plate attached thereto, taken along line IIIB—IIIB in FIG. 3A.
FIG. 3C is a drawing showing a ground terminal in detail.

The leaf spring 26 is composed of a disc portion 26*a*, an anchor portion 26*b* and a contact support 26*c* as shown in FIG. 3A. In the center of the disc portion 26*a*, a hole 26*d* through which the plunger rod 300 extends is formed. An arc-shaped movable contact 22 corresponding to the fixed contacts 21A, 21B is supported on the contact support 26*c*. The contact support 26*c* is sandwiched between an insulating bushing 27 and an insulating washer 25, as shown in FIG. 4. The movable contact 22 is fixed to the contact support 26*c* with studs 22*a*, 22*b* formed integrally with the movable contact 22. The insulating washer 25 is interposed between the movable contact 22 and the contact support 26*c*, and thereby the movable contact 22 is electrically insulated from the contact support 26*c*.

A magnetic plate 210 having a center hole 210*a* is positioned between the auxiliary coil 200 and the leaf spring 26, as shown in FIG. 2. The plunger rod 300 extends through the center hole 210*a*. The magnetic plate 210 is fixed to the leaf spring 26 by caulking studs 210*b* formed integrally with the magnetic plate 210, as shown in FIG. 3B. The leaf spring 26 takes the position shown with dotted lines in FIG. 2 when the auxiliary coil 200 is not energized. Therefore, the movable contact 22 is normally separated from the fixed contacts 21A, 21B.

A separating wall 270 is disposed at the right end of the center housing 1, as shown in FIG. 1, thereby forming a contact chamber R containing the motor switch therein. The auxiliary relay 2 is separated from the motor switch by the separating wall. The separating wall 270 includes a center hole 270*a* through which the plunger rod 300 extends and a side wall 270*b* which is held inside the center housing 1, as shown in FIG. 2. The side wall 270*b* of the separating wall 270 are fixedly held between the supporting disc 23 and a right side edge 114 of the center housing 1. The right side edge 114 is bent to support the separating wall 270 in the center housing 1. The supporting disc 23 is fixedly held between the magnetic plate 100 and the side wall 270*b* of the separating wall 270, as shown in FIG. 2.

A rear housing 4 that serves as a switch cover 420 is connected to the right side of the center housing 1, as shown in FIG. 1. A seal 120 (shown in FIG. 2) is disposed between the center housing 1 and the rear housing 4. The plunger rod 300 extends into the contact chamber R through the center hole 270*a* of the separating wall 270. The movable contact plate 3 made of copper or the like is connected to the right end of the plunger rod 300 via an insulating bushing 32. An insulating washer 33 is disposed at the right end of the bushing 32 and fixed by a snap pin 34. The movable contact plate is biased rightward by a coil spring 31 disposed around the plunger rod 300.

As shown in FIG. 1, a terminal bolt 400 and another terminal bolt 41, both made of copper, are inserted through the switch cover 420. A fixed contact 400*b* is formed at the left end of the terminal bolt 400, and another fixed contact 41*b* is formed at the left end of the terminal bolt 41. The terminal bolt 400 also serves as a battery terminal 400*a*, and the terminal bolt 41 serves as a motor terminal 41*a*. The pair of fixed contacts 400*b* and 41*b* constitute the motor switch together with the movable contact plate 3. The motor switch is positioned in the contact chamber R confined by the rear housing 4 and the separating wall 270.

As shown in FIG. 1, the front housing 10 is connected to the center housing 1 at its left end. A plunger head 17*a* covered with a resilient boot 18 is positioned in the front housing 10. A connecting end 17*b* is formed at the left end of the plunger head 17*a*. A lever 9 for driving a pinion 6*b* toward a ring gear 7 of the internal combustion engine is rotatably supported by a pin 8*a* of a holder 8 fixed to the front housing 10. One end of the lever 9 is movably connected to the connecting end 17*b* of the plunger 17, and the other end is connected to a boss 6*a* of a clutch 6 by a pin. The clutch 6 and the pinion 6*b* is slidably supported by a driving shaft 5*a* of the starter motor 5. The pinion 6*b* is driven leftward by the lever 9 to engage with the ring gear 7 when the pull-in coil 11 is energized.

Figure 5:
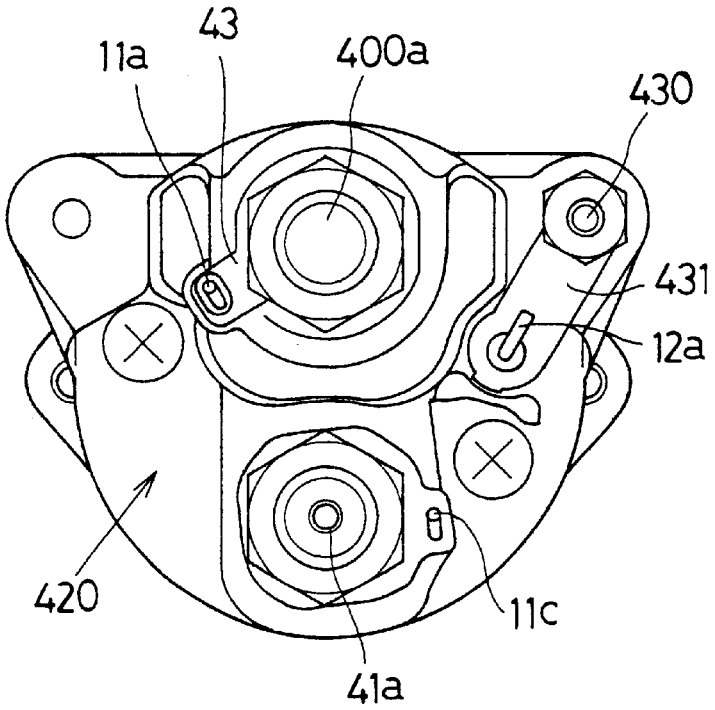
FIG. 5 is a plan view showing a rear housing, viewed from the right side of FIG. 1.
Figure 6:
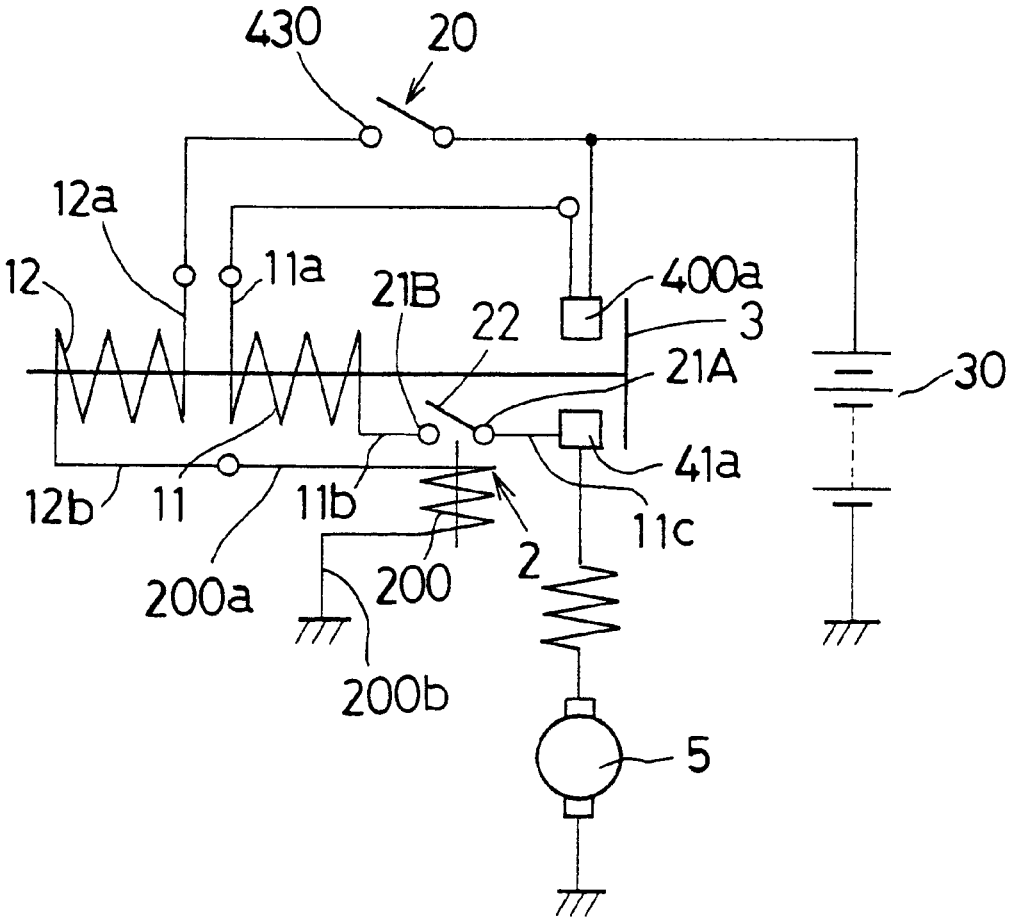
FIG. 6 is a circuit diagram showing electrical connections in the magnetic switch.

FIG. 6 shows electrical connections in the magnetic switch. The electrical connections will be described, referring to FIG. 6 and other accompanying drawings. The fixed contact 21A of the auxiliary relay 2 is connected to the motor terminal 41*a* through a wire 11*c* shown in FIG. 3A. The fixed contact 21B is connected to one end of the pull-in coil 11 through a wire 11*b* led out from the bobbin 13, and the other end of the pull-in coil 11 is connected to the battery terminal 400*a* through a wire 11*a*. The wire 11*a* connected to the battery terminal 400*a* through a connecting plate 43 is shown in FIG. 5. The battery terminal 400*a* is connected to a plus terminal of the battery 30.

One end of the holding coil 12 is connected to a starter switch terminal 430 through a wire 12*a* led out from the bobbin 13 (as shown in FIGS. 3A and 4). The wire 12*a* is soldered to a plate 431 which is connected to the starter switch terminal 430 as shown in FIG. 5. The other end of the holding coil 12 is connected to a wire 12*b* led out from the bobbin 13. The wire 12*b* is connected to a wire 200*a* as shown in FIG. 3A. One end of the auxiliary coil 200 is connected to the wire 12*b* through the wire 200*a*, and the other end of the auxiliary coil 200 is connected to the ground through a wire 200*b* and a ground terminal 200*c*. The wire 200*b* is fixed by a screw 24, and the ground terminal 200*c* is connected to the outer end of the wire 200*b*, as shown in FIG. 3C.

In the circuit described above, a main circuit that includes the wire 12*a*, the holding coil 12, the wires 12*b*, 200*a*, the auxiliary coil 200, and the grounding wire 200*b* is formed upon closing the starter switch 20. The holding coil 12 and the auxiliary coil 200 are energized by the battery 30 through the main circuit. When the auxiliary coil 200 is energized, the magnetic plate 210 fixed to the leaf spring 26 is attracted to the auxiliary coil 200 against the biasing force of the leaf spring 26. The movable contact 22 moves in direction A shown in FIG. 2 (from the dotted line position to the solid line position), and thereby the movable contact 22 contacts the fixed contacts 21A, 21B. Thus, the auxiliary relay 2 is closed, and an auxiliary circuit that includes the battery terminal 400*a*, the wire 11*a*, the pull-in coil 11, the auxiliary relay 2, the motor terminal 41*a* and the starter motor 5 is formed.

When the main circuit and the auxiliary circuit are formed, magnetic force is generated in both the pull-in coil 11 and the holding coil 12. The plunger 17 and the plunger rod 300 are driven by the magnetic force in direction B shown in FIG. 1. The lever 9 connected to the plunger 17 is rotated around the pin 8*a* in direction C shown in FIG. 1. The pinion 6*b* is driven leftward by the lever 9, engaging with the ring gear 7. At the same time, the movable contact plate 3 connected to the plunger rod 300 moves rightward against the biasing force of the coil springs and abuts the pair of contacts 400*b*, 14*b*. Thus, the motor switch composed of the movable contact plate 3 and the pair of fixed contacts 400*b*, 14*b* is closed, forming a circuit for supplying power from the battery 30 to the starter motor 5. Upon closing the motor switch, the starter motor 5 is rotated, and the ring gear 7 of the engine is driven by the starter motor 5.

At an instant when only the auxiliary relay 2 is closed and the motor switch is not yet closed, a small power is supplied to the starter motor 5 through the series circuit including the pull-in coil 11 and the starter motor 5. Since the current supplied to the starter motor 5 is limited by a resistance of the pull-in coil 11 at this instant, the rotational torque of the starter motor 5 is insufficient to rotate the ring rear 7 engaged with the pinion 6*b*. When the main motor switch is closed, a power sufficient to rotate the ring gear 7 is supplied to the starter motor 5, while only a small power is supplied to the pull-in coil 11 which is connected in parallel to the starter motor 5. Therefore, the magnetic force of the pull-in coil 11 is small during the period in which the main starter switch is closed. However, the position of the plunger 17 is kept unchanged during this period by the magnetic force generated in the holding coil 12.

When the engine is cranked up, the starter switch 20 is opened. The circuit including the auxiliary coil 200 is opened, and thereby the auxiliary relay 2 is opened. The magnetic force generated in the holding coil 12 and the pull-in coil 11 disappears, and thereby the plunger 17 returns to its original position by the biasing force of the coil spring 19. Accordingly, the motor switch including the movable contact plate 3 and fixed contacts 400*b*, 14*b* is opened, and at the same time the pinion 6*b* returns to its original position disengaging from the ring gear 7.

The circuit including the motor switch that supplies a large amount of current to the starter motor 5 is separated from the circuit including the starter switch 20, the holding coil 12 and the auxiliary coil 200. Since the later circuit handles only a relatively small amount of current, the circuit can be formed by small size wires, and no relay is necessary to operate the starter switch 20. Accordingly, the magnet switch as a whole can be made at a low cost and in a compact size.

A separating wall 270 that separates the motor switch including the movable contact plate 3 and the fixed contacts 400*b*, 14*b* from the auxiliary relay 2 including the fixed contacts 21A, 21B and the movable contact 22 is provided in the starter motor magnet switch according to the present invention. Therefore, the abrasion copper dusts generated in repeated operation of the motor switch are prevented from entering into the area where the auxiliary relay 2 is located. The movable contact 22, the fixed contacts 21A, 21B, the leaf spring 26 and the auxiliary coil 200 are kept free from the abrasion copper dusts. Malfunctions of the magnetic switch due to defective insulation otherwise caused by the copper dusts are avoided, and the magnetic switch can be properly operated for a long time.

Though the separating wall 270 is positioned in the center housing 1 in the embodiment described above, it may be positioned in the rear housing 4. The separating wall 270 may be fixed to the plunger rod 300 at a position behind the movable contact plate, i.e., at a position opposite to the fixed contacts 400*b*, 14*b*. The separating wall 270 may be modified in various forms as long as it prevents the copper dusts from entering into the space containing the auxiliary relay 2. The separating wall 270 may be made of synthetic resin, a rubber material or a metallic plate, or it may be formed in a film-like diaphragm.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter motor magnetic switch for supplying power from a battery to a starter motor, the starter motor magnetic switch comprising:

a center housing;

a rear housing connected to the center housing at one end thereof;

a holding coil and a pull-in coil wound coaxially around a bobbin and housed in the center housing;

an auxiliary relay including an auxiliary coil, fixed contacts and a movable contact, the auxiliary relay being housed in the center housing, the auxiliary coil being placed coaxially with the holding coil and the pull-in coil in a vicinity thereof;

a plunger having a movable contact plate fixed to one end thereof, the plunger being slidably installed through a center of the holding, pull-in and auxiliary coils, the movable contact plate being housed in the rear housing;

a pair of fixed contacts constituting a motor switch together with the movable contact plate, the pair of fixed contacts being housed in the rear housing, the power of the battery being supplied to the starter motor by closing the pair of the fixed contacts with the movable contact plate upon energization of the holding, pull-in and auxiliary coils, wherein:

a separating wall is disposed in either one of the housings to separate the motor switch from the auxiliary relay, the holding coil and the pull-in coil are so connected that power from the battery is supplied in parallel thereto; and the holding coil and the auxiliary coil are connected in series.

2. The starter motor magnetic switch as in claim 1, wherein:

the starter motor magnetic switch further includes a magnetic core having a center boss, the magnetic core being positioned between the bobbin and the auxiliary coil;

the auxiliary coil is wound around the center boss of the magnetic core; and the magnetic core serves as a magnetic flux path common to all of the holding, the pull-in and the auxiliary coils.

3. The starter motor magnetic switch as in claim 2, wherein:

the auxiliary relay is positioned between the magnetic core and the separating wall;

the movable contact of the auxiliary relay is supported on a leaf spring which exerts a biasing force separating the movable contact from the fixed contacts of the auxiliary relay; and the movable contact and the fixed contacts of the auxiliary relay contact each other against the biasing force upon energization of the auxiliary coil.

4. The starter motor magnetic switch as in claim 3, wherein:

the fixed contacts of the auxiliary relay are supported on a supporting disc made of resin.

5. The starter motor magnetic switch as in claim 4, wherein:

the separating wall includes a side wall; and the supporting disc is fixedly held between the side wall and the magnetic core.

* * * * *